United States Patent [19]

Labate

[11] Patent Number: 4,854,553

[45] Date of Patent: Aug. 8, 1989

[54] SELF SHIELDING LANCE

[76] Inventor: Micheal D. Labate, 115 N. Hazen Ave., Ellwood City, Pa. 16117

[21] Appl. No.: 201,838

[22] Filed: Jun. 3, 1988

[51] Int. Cl.[4] ..... C21C 5/32

[52] U.S. Cl. ..... 266/266; 264/279.1; 266/225; 266/270; 266/220

[58] Field of Search ..... 266/44, 47, 225, 220, 266/266, 270; 264/279.1

[56] References Cited

U.S. PATENT DOCUMENTS

| | | | |
|---|---|---|---|
| 3,082,997 | 3/1963 | Kurzinski | 266/225 |
| 3,379,428 | 4/1968 | Dortenzo et al. | 239/132.3 |
| 3,645,520 | 2/1972 | Acre et al. | 266/225 |
| 3,898,078 | 8/1975 | Huber | 266/225 |
| 4,326,701 | 4/1982 | Hayden, Jr. et al. | 266/225 |

FOREIGN PATENT DOCUMENTS

| | | | |
|---|---|---|---|
| 36053 | 8/1986 | Japan | 266/225 |

*Primary Examiner*—Robert McDowell

*Attorney, Agent, or Firm*—Harpman & Harpman

[57] ABSTRACT

Apparatus for introducing stirring and refining agents into molten metal in a vessel using a lance having an elongated refractory body with a bore extending inwardly of a first or upper end of the refractory body and terminating inwardly of a second or delivery end thereof. A plurality of small tubes are positioned within the refractory body and communicate with the bore and the exterior of the refractory body whereby gas introduces into the bore flows through the small tubes to the delivery end and sides of the lance and bubbles upwardly shielding the lance from the rapid erosion that occurs when molten slag and steel attack the material of the lance due to the chemistry and temperature of the molten metal.

7 Claims, 3 Drawing Sheets

SELF SHIELDING LANCE

BACKGROUND OF THE INVENTION

1. Technical Field:

This invention relates to lances such as used for introducing an inert gas into molten metal for stirring the same or for injecting a stream of oxygen into molten metal for refining the same.

2. Description of the Prior Art:

Lances for introducing gases into molten metal for various purposes are disclosed in U.S. Pats. Nos. 3,379,428 and 3,082,997 wherein the lances incorporate straight metal tubes forming a plurality of gas conduits arranged to direct gas downwardly into the molten metal in which the lance is positioned.

U.S. Pat. Nos. 3,645,520 and 3,898,078 disclose lances in which the gas conveying conduits are formed in several patterns.

None of the prior art known to applicant has disclosed a structure in which argon gas or the like is introduced into the lance and directed through the body thereof in a manner to shield the outer surfaces of the lance and particularly the upper portions thereof which are in direct contact with molten slag on the molten metal whereby the areas thereof normally subjected to rapid erosion are shielded by an annular current of rolling, swirling molten metal around the lance which serves to move the lighter molten slag away from the lance.

The present invention relates to a substantially improved lance for treating molten metals in which the principal body of the lance is formed of a refractory material with a bore extending longitudinally through a portion of the refractory material and terminating inwardly of the delivery end of the lance where it communicates with a plurality of metal tubes each of which may be shaped to form a controlled limited passageway of a desired size with the distal ends of the metal tubes communicating with the delivery end of the lance and of equal importance wherein some of the plurality of metal tubes forming passageways communicate with the bore extending longitudinally therein in areas of the lance inwardly of the first or upper end thereof and with the exterior of the lance whereby the distal ends of these metal tubes direct gas flowing therethrough into an annular column around the exterior of the lance creating an annular rising column of molten metal which serves to protect and shield the upper portions of the lance from the slag on the molten metal. In addition to or in place of the tubes communicating with the exterior of the lance, the refractory body may be porous refractory with interconnecting cavities so that gas delivered into the interior of the body will flow through the porous refractory and be delivered over the surface of the refractory body where it will form bubbles flowing upwardly and thereby create annular rising columns of swirling, mixing molten metal which will move molten slag thereon away from the lance and thus shield the same from the erosion which would otherwise result.

SUMMARY OF THE INVENTION

A lance for treating molten metal by introducing inert gas for stirring or for injecting oxygen or another gas into the molten metal or slag has an elongated refractory body with a bore or a main tube extending partially axially thereof and passageways communicating with said bore and with the exterior of the lance including the delivery end of the lance for creating a bubbling and stirring action in the molten metal and whereby gas introduced into the lance will cause gas bubbles to rise upward in an enveloping rising column of molten metal shielding the body of the lance and moving slag on the molten metal away from the lance so as to control rapid erosion that otherwise occurs.

DESCRIPTION OF THE PREFERRED EMBODIMENT

Figure 1:
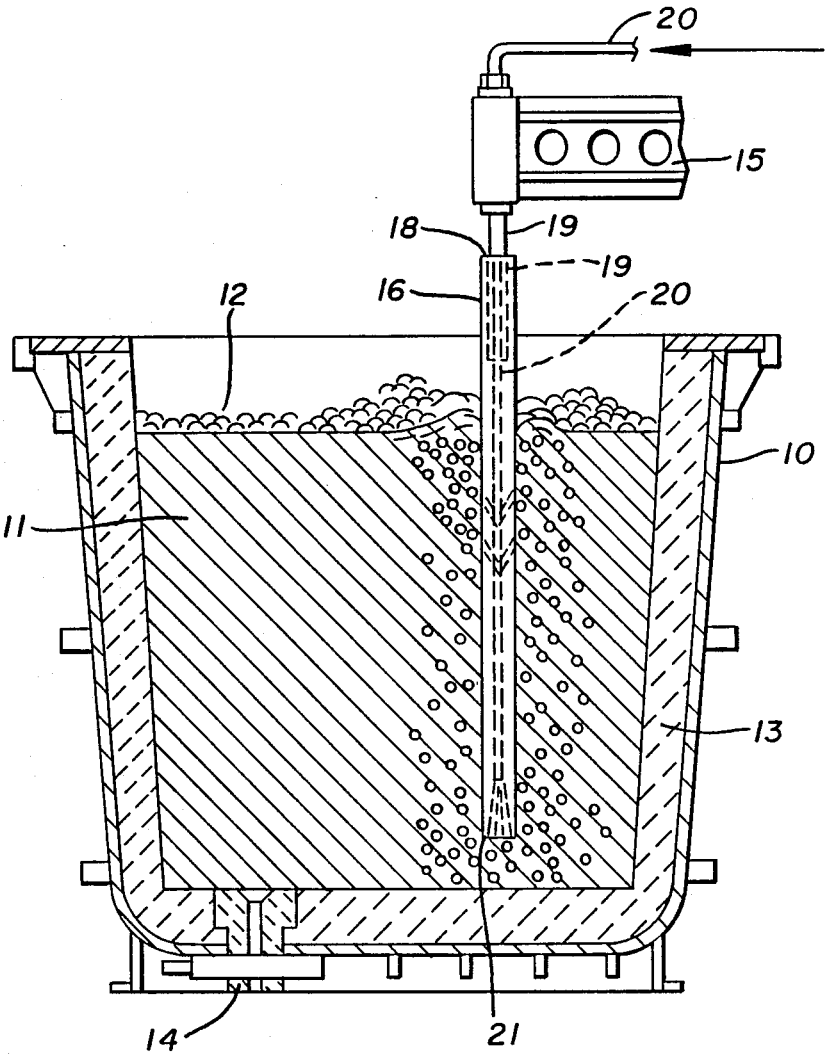
FIG. 1 is a vertical section of a ladle illustrating molten metal therein with slag thereon and the lance of the invention positioned therein.

By referring to the drawings and FIG. 1 in particular it will be seen that a vessel 10, such as a ladle, is illustrated in vertical section as containing molten metal 11 on which a layer of slag 12 is shown. The vessel 10 is provided with the usual refractory lining 13 and has a valved tap hole 14 in the lower portion thereof. A support arm 15 positions a lance vertically largely immersed in the molten metal 11 in the vessel 10, the lance having an elongated refractory body 16 which is preferably cross sectionally square.

Figure 2:
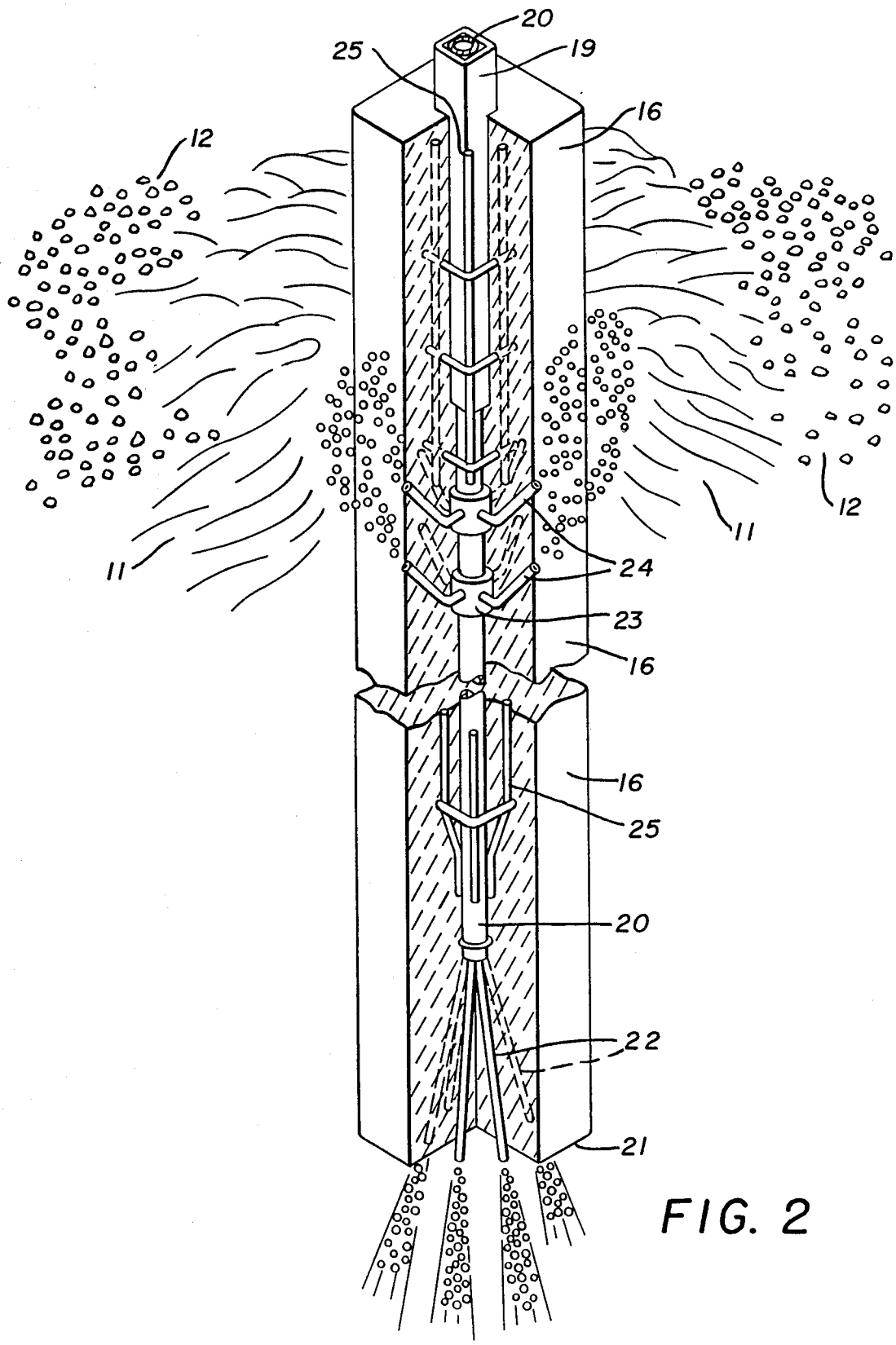
FIG. 2 is a perspective view with parts broken away and parts in cross section illustrating the lance incorporating a structure therein introducing gas to the exterior thereof.

A first or normally upper end 18 of the lance is positioned above the upper end of the vessel 10 and metal tubes 19 and 20 extending through a portion of the support arm 15 extend downwardly into the refractory body 16 of the lance. The metal tube 19 terminates a short distance inwardly of the first or upper end 18 of the lance as best seen in FIG. 2 of the drawings and the metal tube 20 extends downwardly throughout most of the refractory body 16 of the lance and terminates inwardly of the second or delivery end 21 thereof. The tube 20 defines a bore.

In a preferred form of the invention, a plurality of smaller metal tubes 22 communicate with the tube 20 and extend to the second or delivery end 21 of the lance and they are so arranged and formed that direction of a suitable gas such as argon therethrough will create mixing and stirring patterns in the molten metal as desired. The gas is supplied through the metal tube 20 which extends upwardly through the support arm 15 and communicates with a source of gas, not shown.

In FIG. 2 of the drawings, fittings 23 communicate with the metal tube 20 and a plurality of secondary small metal tubes 24 communicate with the fittings and form passageways communicating with the exterior of the refractory body 16. The arrangement is such that gas introduced into the metal tube 20 will thus flow downwardly therethrough and emerge from the second or delivery end 21 of the lance in the manner of the lances heretofore known in the art.

Additionally and importantly, some of the gas introduced into the tube 20 will flow through the fittings 23 and the passageways defined by the plurality of secondary small metal tubes 24 to the exterior of the refractory body 16 so as to form an annular area thereabout of bubbles rising in the molten metal in addition to the bubbles formed by the gas emerging from the second or delivery end 21 of the lance. The rising bubbles will cause the molten metal 12 to rise up in an annular column as illustrated in FIG. 2 of the drawings and thus cause the slag 12 to move outwardly and away from the refractory body 16 of the lance thereby shielding it from the erosion that otherwise occurs rapidly at the so-called slag line where molten slag on the molten metal would otherwise contact and rapidly erode the refractory body of the lance.

In FIG. 2 of the drawings, reinforcing metal rods 25 are attached to the tube 19 which is illustrated as being cross sectionally square and the rods 25 extend into the refractory body member 16. The reinforcing rods 25 preferably extend longitudinally of the elongated refractory body 16 and are again supported in the lower portion of the refractory body by being attached to the tube 20.

Figure 3:
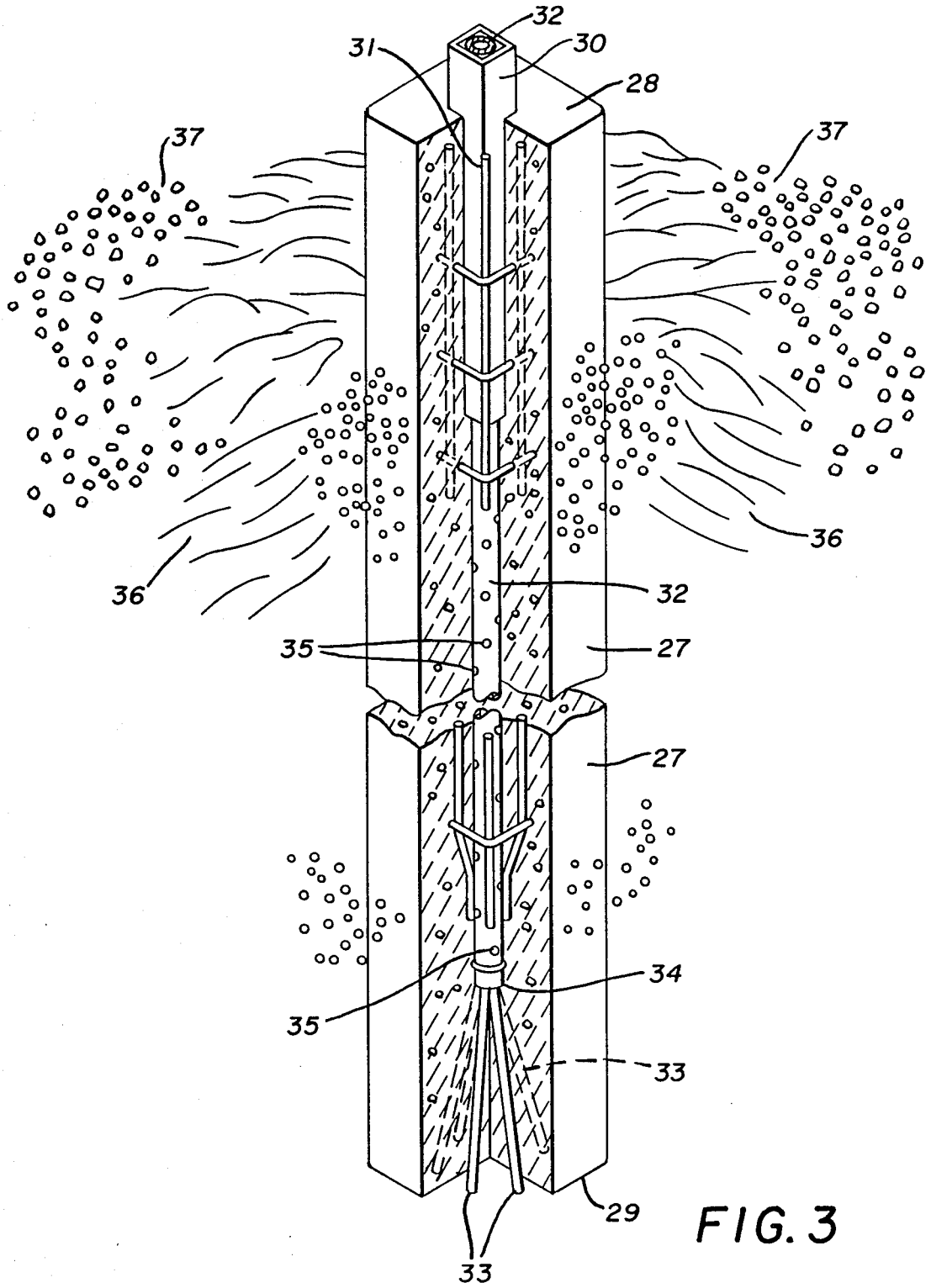
FIG. 3 is a perspective view with parts broken away and parts in cross section illustrating the lance with a porous refractory body through which some of the gas introduced into the lance is directed to the exterior thereof to form a protecting rising column of bubbles and molten metal shielding the lance from slag.

Modifications of the structure hereinbefore described will occur to those skilled in the art and one such modification is illustrated in FIG. 3 of the drawings and by referring thereto it will be seen that an elongated lance is formed of a porous refractory body 27 which is preferably cross sectionally square and has a first or upper end 28 and a second or delivery end 29. A reinforcing and supporting metal tube 30 carrying spaced reinforcing members 31 is positioned in the upper end of the refractory body 27 and a gas delivery tube 32 extends downwardly through the tube 30 and axially of the porous refractory body 27 to a point inwardly of the second or delivery end 29 thereof. A plurality of small tubes 33 communicate with a fitting 34 on the inner end of the tube 32 so that gas delivered thereinto as hereinbefore described in connection with FIGS. 1 and 2 of the drawings will flow downwardly through the lance and out of the small tubes 33 which communicate with the second or delivery end 29 of the lance. The gas delivery tube 32 is provided with a plurality of apertures 35 which communicate with the bore thus defined in the porous refractory body 27 so that some of the gas flowing downwardly through the gas delivery tube 32 will flow outwardly into the porous refractory body 27 of the lance and outwardly of the exterior thereof where it will form a plurality of bubbles completely encircling the refractory body 27 of the lance, which bubbles will rise upwardly in the molten metal 36 as seen in FIG. 3 of the drawings and thus cause the slag 37 thereon to move away from the refractory body 27 of the lance so as to shield the lance from the rapid erosion that would otherwise occur when the molten slag contacts the refractory body of the lance.

In both forms of the invention as illustrated in FIGS. 2 and 3 of the drawings, the plurality of small tubes or passageways 22 and 33 respectively, are preferably shaped to form predetermined sized limited area openings such as generally elongated oval shapes or rectangular slots which will act as jets in increasing the velocity of the gas directed thereto and at the same time and importantly insure that sufficient gas pressure is maintained in the supply tube in the lance to supply the bubbles emerging from the sides of the lance and rising upwardly in a column of rising molten metal which shields the lance from the slag as hereinbefore described.

By way of example, gas supplied to the gas supply tube of the lance at 300 pounds per square inch can be desirably discharged at the rate of 200 feet per minute by preshaping the small tubes or passageways communicating with the second or delivery end of the lance so as to form flattened oval shapes or rectangular slots, for example wherein the diameter of the smaller tubes is a quarter of an inch o.d. and flattened to an increased width of 5/16th of an inch, a flattened discharge orifice of 0.026/100ths of an inch by 0.26/100ths of an inch in width is created.

Although but two embodiments of the present invention have been illustrated and described, it will be apparent to those skilled in the art that various changes and modifications may be made within departing from the spirit of the invention and having thus described my invention what I claim is:

1. A lance for use in treating a bath of molten metal comprising an elongated refractory body, a bore axially of said elongated refractory body, a tube communicating with said bore and extending out of a first end thereof, said bore terminating inwardly of a second end of said refractory body, a plurality of small tubes defining passageways embedded in said refractory body communicating with said bore and extending therefrom to said second end and to the sides of said refractory body, support means engaging said bore adjacent said first end of said refractory body which said lance may be supported and connected with a source of gas to be directed therethrough, at least a portion of each of said small tubes being formed in a narrow passageway whereby a controlled discharge rate of gas at a controlled pressure can be discharged thereby.

2. The lance for use in treating a bath of molten metal set forth in claim 1 and wherein some of said plurality of small tubes extend to the exterior of said second end of said elongated refractory body and the remaining tubes extend to the sides of said elongated refractory body in angular relation to said axially disposed bore.

3. The lance for use in treating a bath of molten metal set forth in claim 1 and wherein said refractory body is porous and said plurality of small tubes in said refractory body communicating with said bore extend to said second end of said porous refractory body and wherein said bore communicates with said porous refractory body so that gas delivered to said bore flows through said small tubes and through said porous refractory body.

4. The lance for use in treating a bath of molten metal set forth in claim 1 and wherein some of said plurality of small tubes in said refractory body communicating with said bore extend to the sides of said refractory body between the first and second ends thereof and wherein each of said plurality of small tubes is of a size to control the volume and rate of flow of gas directed therethrough.

5. The lance for use in treating a bath of molten metal set forth in claim 1 and wherein some of said plurality of small tubes in said refractory body communicating with said bore extend to said second end of said refractory body and the remainder of said plurality of small tubes extend to the sides of said refractory body between said first and second ends thereof and wherein each of said plurality of small tubes is partially flattened to control the volume and flow of gas directed therethrough.

6. A lance for use in treating a bath of molten metal comprising an elongated porous refractory body, a bore axially of said elongated porous refractory body, a tube communicating with said bore and extending out of a first end thereof, said bore terminating inwardly of a second end of said porous refractory body, a plurality of small tubes embedded in said porous refractory body communicating with said bore and extending therefrom to said second end of said porous refractory body, said bore communicating with said porous refractory body so that gas delivered to said bore flows through said plurality of small metal tubes extending to said second end of said porous refractory body and through said porous refractory body to the exterior of the sides thereof, support means engaging said bore adjacent said first end of said porous refractory body by which said lance may be supported and connected with a source of gas to be directed therethrough.

7. A method of making an elongated refractory lance used in treating a bath of molten metal comprising the steps of: assembling a core structure of a first elongated gas delivery tube having a plurality of relatively smaller secondary gas delivery tubes communicating therewith at spaced locations on said first gas delivery tube and extending therefrom to a plurality of positions defining the sides and an end of said elongated refractory lance; forming an elongated refractory body about said elongated core structure so as to embed said core structure therein with said plurality of relatively smaller tubes defining passageways in said elongated refractory body communicating with the sides and an end of said refractory lance.

* * * * *